US008628905B2

(12) United States Patent
Kobayashi et al.

(10) Patent No.: US 8,628,905 B2
(45) Date of Patent: Jan. 14, 2014

(54) FERRITE CORE MATERIAL FOR RESIN-FILLED TYPE CARRIER, RESIN-FILLED TYPE CARRIER, AND ELECTROPHOTOGRAPHIC DEVELOPER USING THE CARRIER

(75) Inventors: Hiromichi Kobayashi, Kashiwa (JP); Tsuyoshi Itagoshi, Kashiwa (JP); Tomoyuki Suwa, Kashiwa (JP); Toshio Honjo, Kashiwa (JP)

(73) Assignee: Powdertech Co. Ltd., Chiba (JP)

( * ) Notice: Subject to any disclaimer, the term of this patent is extended or adjusted under 35 U.S.C. 154(b) by 0 days.

(21) Appl. No.: 11/443,433

(22) Filed: May 31, 2006

(65) Prior Publication Data

US 2006/0269862 A1 Nov. 30, 2006

(30) Foreign Application Priority Data

May 31, 2005 (JP) ..... 2005-160256

(51) Int. Cl.
*G03G 9/113* (2006.01)

(52) U.S. Cl.
USPC ..... 430/111.4; 430/111.32; 430/111.34; 430/111.41

(58) Field of Classification Search
USPC ..... 430/111.32, 111.34, 111.4, 111.41
See application file for complete search history.

(56) References Cited

U.S. PATENT DOCUMENTS

| | | | | |
|---|---|---|---|---|
| 5,078,085 | A * | 1/1992 | Fuji et al. | 399/236 |
| 5,395,717 | A * | 3/1995 | Ozawa et al. | 430/111.35 |
| 5,834,152 | A * | 11/1998 | Yasunaga et al. | 430/122.2 |
| 5,998,076 | A | 12/1999 | Mahabadi et al. | |
| 6,506,531 | B1 * | 1/2003 | Hakata et al. | 430/111.33 |
| 6,660,444 | B2 | 12/2003 | Mahabadi et al. | |
| 6,936,394 | B2 * | 8/2005 | Okado et al. | 430/111.33 |
| 2002/0146632 | A1 * | 10/2002 | Kurosu et al. | 430/122 |
| 2003/0091922 | A1 * | 5/2003 | Okado et al. | 430/111.33 |
| 2004/0229151 | A1 * | 11/2004 | Kobayashi et al. | 430/111.32 |
| 2005/0238392 | A1 * | 10/2005 | Okamoto et al. | 399/269 |

FOREIGN PATENT DOCUMENTS

| | | |
|---|---|---|
| JP | 54-078137 | 6/1979 |
| JP | 59-048774 | 3/1984 |
| JP | 05-040367 | 2/1993 |
| JP | 05-341578 | * 12/1993 |
| JP | 08-022150 | * 1/1996 |
| JP | 08-160673 | * 6/1996 |
| JP | 10-125524 | * 5/1998 |
| JP | 11-295933 | 10/1999 |
| JP | 11-295935 | 10/1999 |

OTHER PUBLICATIONS

English translation of JP 08-022150 published Jan. 1996.*
Translation of JP 10-125524 published May 1998.*

* cited by examiner

*Primary Examiner* — Peter Vajda
(74) *Attorney, Agent, or Firm* — Greenblum & Bernstein, P.L.C.

(57) ABSTRACT

A ferrite core material for a resin-filled type carrier, and a resin-filled type carrier which is used as an electrophotographic developer by mixing a toner, sufficiently secure the image density, have no carrier adhesion and can maintain high-quality images over a long period, and an electrophotographic developer using the carrier, are provided. A ferrite core material for a resin-filled type carrier characterized in a void fraction of 10 to 60%, a resin-filled type carrier filled in the carrier core material with a resin, and an electrophotographic developer composed of the resin-filled type carrier and a toner, are provided.

24 Claims, 1 Drawing Sheet

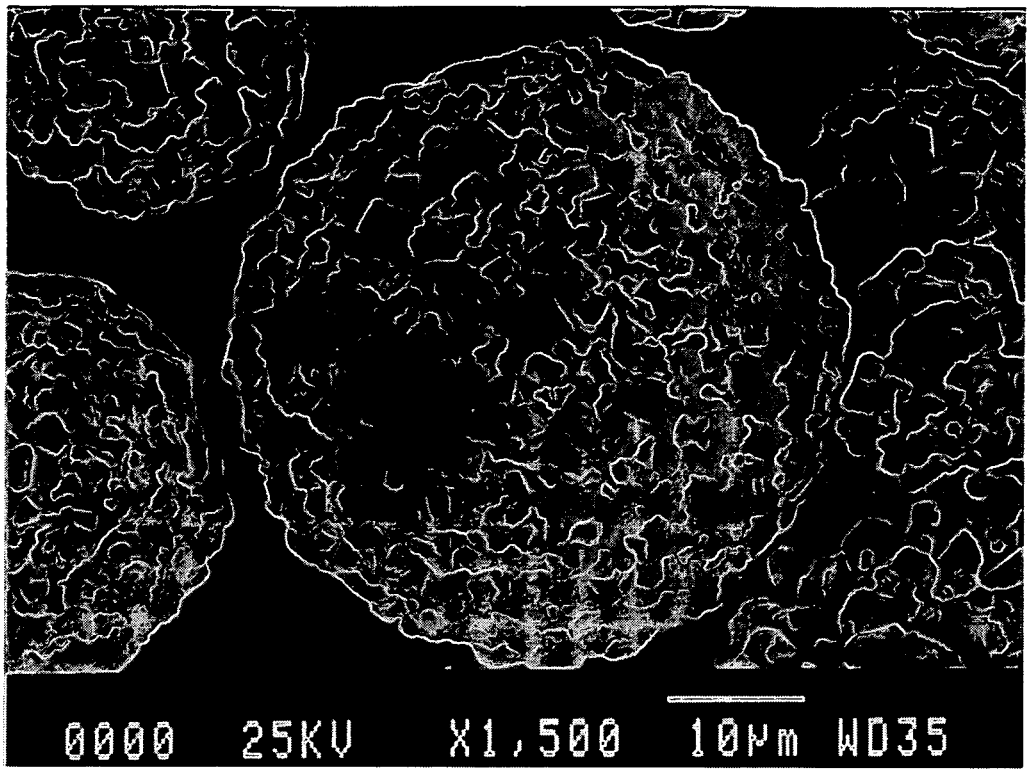
0000 25KV X1,500 10μm WD35

FERRITE CORE MATERIAL FOR RESIN-FILLED TYPE CARRIER, RESIN-FILLED TYPE CARRIER, AND ELECTROPHOTOGRAPHIC DEVELOPER USING THE CARRIER

BACKGROUND OF THE INVENTION

1. Field of the Invention

The present invention relates to a ferrite core material for a resin-filled type carrier and a resin-filled type carrier used for a two-component electrophotographic developer used in copying machines, printers and the like, and an electrophotographic developer using the carrier, particularly to a ferrite core material for a resin-filled type carrier and a resin-filled type carrier which have a low true density, an elongated life, an easily controllable charging amount, etc. and a high strength, and generate little cracking, deformation and melting by heat and impact, and an electrophotographic developer using the carrier.

2. Description of the Related Art

The electrophotographic developing method is one which develops images by adhering toner particles in a developer to electrostatic latent images formed on a photoreceptor, and the developers used in this method are classified into a two-component developer composed of toner particles and carrier particles, and a one-component developer using toner particles alone.

As the developing method using a two-component developer composed of toner particles and carrier particles among such developers, although the cascade method, etc., was formerly used, the magnetic brush method using a magnet roll prevails at present.

In a two-component developer, the carrier particles are a carrier material which is mixed and agitated with the toner particles in a development box filled with the developer to impart a desired charge to the toner particles, and carries the charged toner particles to a photoreceptor surface to form toner images. The carrier particles remaining on a development roll holding a magnet are again returned from the development roll to the development box, mixed and agitated with new toner particles, and repeatedly used in a certain period.

The two-component developer, unlike the one-component developer, is one in which carrier particles are mixed and agitated with toner particles, charge the toner particles, and further have a function of transporting them, thus having good controllability in developer design. Therefore, the two-component developer is suitable for full-color developing devices requiring high-quality images, high-speed printing machines requiring reliability and durability of image sustainability, and the like.

The two-component developer used in such ways requires image characteristics, such as image density, fogging, white spots, gradation and resolution, exhibiting predetermined values from the early stage, and stably maintaining these characteristics without variation in them during a continuous printing period. For stably maintaining these characteristics, the stability of the carrier particles contained in the two-component developer is required.

As carrier particles forming a two-component developer, iron powder carriers such as iron powder coated on its surface with an oxide film and iron powder coated on its surface with a resin have conventionally been used. Such iron powder carriers have an advantage of easily providing images good in reproducibility in solid parts because of their high magnetization and conductivity.

However, since such iron powder carriers have high own weights and too high magnetizations, fusion of the toner to the surface of the iron powder carrier, so-called toner spent, becomes liable to occur by mixing and agitation with the toner particles in a development box. The occurrence of such toner spent reduces the available carrier surface area, becoming liable to decrease the friction chargeability with the toner particles.

The resin-coated iron powder carrier sometimes generates the charge leak due to exfoliation of the surface resin by stress during endurance, and exposure of the core material (iron powder) having a high conductivity and a low dielectric breakdown voltage. Such charge leak breaks electrostatic latent images formed on a photoreceptor, and generates brush strokes and the like on solid parts, causing inferior durability such as hardly providing uniform images. By these reasons, the iron powder carriers such as the oxide-filmed iron powder and the resin-coated iron powder come at present not to be used.

As described in Japanese Patent Laid-Open No. 59-48774 (Patent Document 1), resin-coated ferrite carriers have been recently often used, in which a ferrite core material, having a low true specific gravity of about 5.0 and a low magnetization, is used in place of iron powder carriers, and is coated on its surface with a resin, and the developer life has been remarkably elongated.

However, with evolution from an era of simple function copying machines to that of combined machines with recently progressing office network, and with the service systems shifting from a system where contracted servicemen periodically exchange developers, etc., for maintenance to a maintenance-free era, the market comes to have the much larger need for the elongated life of developers.

Further, offices come to accept full-color images and have the larger need for high-quality images, and the toner particle size becomes smaller to obtain a high resolution.

Responding to this, there is the need for quick charging of the toner in a desired charge, and the carrier particle size has shifted to the small particle size with a high specific surface area. When the particle size distribution is totally made to be of a small particle size, especially particles on the fine powder side become liable to bring about the phenomenon of the carrier particles scattering or adhering to a photoreceptor, which is a disadvantage of the two-component developer, and induce fatal image faults such as white spots. Therefore, the small size carrier must be controlled to have a narrower particle size distribution width.

For solving the problems as above, many magnetic powder-dispersed carriers in which fine magnetic powders are dispersed in resins are proposed in Japanese Patent Laid-Open No. 5-40367 (Patent Document 2), etc., to make the carrier particles light, and elongate the developer life.

Since the true densities of such magnetic powder-dispersed carriers can be decreased by reducing the magnetic powder amount, thus reducing the stress by agitation, the chipping and exfoliation of the coated film is prevented, providing stable image characteristics over a long period.

However, since the magnetic powder-dispersed carriers are coated on the magnetic powders with binder resins, the carrier resistance is high. Therefore, they have a problem of hardly providing a sufficient image density.

The magnetic powder-dispersed carriers sometimes raise problems that magnetic fine particles are solidified with binder resins, and drop off by the agitation stress and the impacts in developing machines, and that the carriers themselves break possibly due to their low hardness as compared with those of iron powder carriers and ferrite carriers conventionally used. Then, dropped-off magnetic fine particles and the broken carrier particles adhere to a photoreceptor, and sometimes cause image faults.

Additionally, the magnetic powder-dispersed carriers have a disadvantage of having a high residual magnetization and a high coercive force because of use of fine magnetic particles, and deteriorating the fluidity of the developers. Especially when magnet brushes are formed on a magnet roll, high-quality images can hardly be obtained, because the fluidity is bad due to the high residual magnetization and coercive force, and bristles of the magnetic brushes are hardened. Further, even when the carrier leaves the magnet roll, since the carrier magnetic aggregation does not come loose, and the carrier cannot be rapidly mixed with a supplied toner, the rising of the charge quantity is bad, raising a problem of causing image faults such as toner scattering and fogging in images.

Further, although the magnetic powder-dispersed carriers can be fabricated by two methods of the crushing one and the polymerization one, both have a problem of a high producing cost because the crushing method is bad in yield, and the polymerization method is complicated in the producing process.

A resin-filled type carrier in which voids in a porous carrier core material is filled with a resin is proposed as one in place of the magnetic powder-dispersed carriers. For example, Japanese Patent Laid-Open No. 11-295933 (Patent Document 3) and Japanese Patent Laid-Open No. 11-295935 (Patent Document 4) describe cores or hard magnetic cores, polymers contained in the pores of cores, and carriers including coatings which coat the cores. These resin-filled type carriers are supposed to provide carriers which have little impact, desired fluidities, wide ranges of friction charging values, desired conductivities, and certain ranges of the volume average particle sizes.

Here, Patent Document 3 supposes that as the core material, various appropriate porous solid core carrier materials such as existing porous cores can be used. It describes that especially important are the porousness and the desired fluidity, and lists the soft magnetization, the porosity indicated by the BET area and the volume average particle size as noteworthy properties.

However, the porosity of about 1,600 $cm^2/g$ in BET area as described in the example of the Patent Document cannot provide a sufficiently low specific gravity even when voids are filled with a resin, and cannot respond to the recently increasing need for the elongated life of developers.

The measurement principle of BET area is to measure the physical adsorption and the chemical adsorption of a specific gas, and has no correlation with a core material porosity. That is, even a core material scarcely having pores generally varies in the BET area depending on its particle size, particle size distribution, surface material, etc. Then, even if the porosity is controlled through the BET area measured in such a way, the core material cannot be said to be one which can be filled fully with a resin. When a large amount of a resin is tried to be filled in a core material with no porosity or insufficient porosity, but with a high BET area, the unfilled residual resin is present independently without adhering to the core material, floats in the carrier, generates much aggregation of the particles, deteriorates the fluidity, largely varies in charging characteristics on loosening of the aggregate in an actual use period, and soon, thereby making obtaining of stable characteristics difficult.

Additionally, the precise control of the specific gravity and mechanical strength of the carrier after resin filling is, needless to say, difficult only by simply controlling the porosity expressed by the BET area.

Further, a sponge iron powder used in example cannot achieve a sufficiently light weight even after resin filling, and cannot possibly achieve a desired elongated life.

Additionally, the Patent Document uses a porous core, and the total content of a resin filled therein and a resin coated on the surface thereof is set to be preferably about 0.5 to about 10 wt. % of the carrier. Further, in example in the Patent Document, the resins are at most 5 wt. % with respect to the carrier. Such a small amount of the resins cannot achieve a desired low specific gravity, is not at all different from conventionally used resin-coated carriers, and can only provide similar performances.

Further, the Cu—Zn ferrite used in example contains much amount of heavy metals, and must be anyway discarded even if the developer life is elongated, thus not in line with the current of the recent years' environmental load reduction.

Use of a hard magnetization core as described in Patent Document 4 brings about a disadvantage of worsening the fluidity of the developer because of its high residual magnetization and coercive force. Especially when magnet brushes are formed on a magnet roll, high-quality images can hardly be obtained because the fluidity is bad due to the high residual magnetization and coercive force, and bristles of the magnetic brushes are hardened. Further, even when the carrier leaves the magnet roll, since the carrier magnetic aggregation does not come loose, and the carrier cannot be rapidly mixed with a supplied toner, the rising of the charge quantity is bad, raising a problem of causing image faults such as toner scattering and fogging in images.

Japanese Patent Laid-Open No. 54-78137 (Patent Document 5) describes a carrier for an electrostatic image developer in which pores and recesses of the surface of magnetic particles which have a lower bulk specific gravity than substantially non-porous ones and which are porous or have a large surface roughness are filled with a fine powder of an electric insulation resin, and contends that a developer is provided by using the carrier, which developer has advantages that, with the carrier having little toner accumulation on the carrier surface, the developer has little change in powder characteristics and friction charging characteristics under varying temperature and humidity conditions, and has a constant image density with time lapse and no decrease in the image density.

However, when a fine powder is filled in pores of magnetic particles which are porous or have a large surface roughness, if the iron powder is used as described in example of the Patent Document, the fine powder is relatively easily filled, but is difficult to be filled in very fine voids as is the case with voids in ferrite core materials.

When a fine powder dispersed in a solvent is tried to be filled, if the core material is an iron powder, it can be filled relatively uniformly as described above, but if the core material is a ferrite one, the solvent only permeates voids of the core material, resulting in the dispersed fine powder present on the core material surface. The powder easily drops off by being subject to the mechanical stress in developing machines, leading to disadvantages of remarkable changes in the charging characteristics and resistance characteristics.

For example, an iron oxide powder (trade name: TEFV, manufactured by Powdertech Co., Ltd.) as described in example of the Patent Document has a rough and uneven surface, but does not have porousness as is the case with the present invention as described later, and is besides made of iron powder, so a sufficiently low specific gravity cannot be achieved.

As described above, even the carriers described in Patent Documents 3 to 5 cannot sufficiently satisfy the needs that the image density is sufficiently secured; the carrier adhesion does not occur over a long period; and high-quality images can be maintained.

SUMMARY OF THE INVENTION

Accordingly, the present invention has an object to provide a ferrite core material for a resin-filled type carrier, and a resin-filled type carrier which is used as an electrophotographic developer by mixing with a toner, sufficiently secure the image density, have no carrier adhesion and can maintain high-quality images over a long period, and to provide an electrophotographic developer using the carrier.

As the results of the extensive studies by the present inventors, we have found that, for not generating the carrier adhesion and for maintaining high-quality images over a long period, first of all the void factor of a carrier core material is set to be constant, and the resin filling amount in voids is set to be in a specified range, thus achieving the above object, and achieved the present invention.

Namely, the present invention is to provide a ferrite core material for a resin-filled type carrier characterized by a void fraction of 10 to 60%.

The above ferrite core material for a resin-filled type carrier has desirably a continuous void degree of 1.8 to 4.0.

The above ferrite core material for a resin-filled type carrier has desirably a true density of 3.0 to 5.5 g/cm$^3$.

The above ferrite core material for a resin-filled type carrier has desirably an apparent density of 0.7 to 2.5 g/cm$^3$.

The above ferrite core material for a resin-filled type carrier has desirably an average particle size of 15 to 80 μm.

The above ferrite core material for a resin-filled type carrier has desirably a resistance of $10^2$ to $10^{12}\Omega$.

The above ferrite core material for a resin-filled type carrier is desirably a ferrite containing at least one selected from the group consisting of Mn, Mg, Ca, Sr, Li, Ti, Al, Si, Zr and Bi.

The above ferrite core material for a resin-filled type carrier has desirably a residual magnetization of 15 emu/g (A·m$^2$/kg) or less.

The ferrite core material for a resin-filled type carrier composed of the above ferrite has desirably a sintered primary particle size of 0.2 to 10 μm.

The ferrite core material for a resin-filled type carrier composed of the above ferrite has desirably a ratio of a volume average particle size to the sintered primary particle size (a volume average particle size/the sintered primary particle size) of 5 to 200.

The present invention also provides a resin-filled type carrier obtained by filling the above ferrite core material for a carrier with a resin.

The above resin-filled type carrier has desirably a resin filling amount of 6 to 30 wt. %.

The above resin-filled type carrier has desirably a void factor of 1 to 50%.

The above resin-filled type carrier has desirably a ratio of a resin-filled area rate to a core material area rate (a resin filled area rate/a core material area rate) of 0.20 to 0.80.

The above resin-filled type carrier has desirably a true density after resin filling of 2.50 to 4.50 g/cm$^3$.

The above resin-filled type carrier has desirably a ratio of the true density after resin filling to the true density of the core material (the true density after resin filling/the true density of the core material) of 0.50 to 0.90.

The above resin-filled type carrier has desirably an average particle size of 15 to 80 μm.

The above resin-filled type carrier has desirably a magnetization of 20 to 90 emu/g (A·m$^2$/kg).

The above resin-filled type carrier has desirably an electric resistance of $10^5$ to $10^{15}\Omega$.

The above resin-filled type carrier is desirably coated with a resin.

The above resin-filled type carrier coated with a resin has desirably a surface coating thickness of 0.01 to 7 μm.

The present invention also provides an electrophotographic developer composed of a resin-filled type carrier and a toner.

A ratio of a true density of the above toner to the true density of the above resin-filled type carrier (a true density of the toner/the true density of the carrier) of 1/5 to 1/2.

The resin-filled type carrier relevant to the present invention has, since filled with a resin, a low true density, an elongated life and an excellent fluidity, and the selection of filling resins makes control of charge quantity, etc., easy. Moreover, it has a high strength as compared with magnetic powder-dispersed carriers, and further does not generates cracking, deformation and melting by heat and impact.

BRIEF DESCRIPTION OF THE DRAWINGS

FIG. 1 is an electron microscopic photograph of a core material of ferrite particles in Example 1a.

DETAILED DESCRIPTION OF THE PREFERRED EMBODIMENTS

Hereinafter, preferred embodiments to practice the present invention will be described.

<A Resin-Filled Type Carrier Core Material Relevant to the Present Invention>

A resin-filled type carrier core material relevant to the present invention has a void fraction of 10 to 60%, desirably 15 to 55%, more desirably 20 to 55%. The void fraction of less than 10% provides too few voids, not achieving a low specific gravity even if a resin is filled. The void fraction of more than 60% provides too much void, not enhancing the strength even if a resin is filled, and the carrier may possibly be broken in practical uses.

A resin-filled type carrier core material relevant to the present invention has a continuous void degree of desirably 1.8 to 4.0, more desirably 1.8 to 3.5, further desirably 2.0 to 3.0. The continuous void degree of less than 1.8 provides few voids continuing from the surface, making the resin filling difficult and hardly achieving a low specific gravity. With the continuous void degree of more than 4.0, a large amount of a resin is needed when the resin is filled in voids continuing from the surface, which is not favorable in points of productivity and cost.

Thus, since ferrites have voids independently present inside in addition to voids continuing from the surface, and both of them have a large influence on the specific gravity and mechanical strength, simple control of the BET area only, while achieving a desired low specific gravity, cannot provide a carrier which has an excellent mechanical strength and can maintain high-quality images over a long period. Also from the above points, "void fraction" and "continuous void degree" disclosed in the present invention are very important.

A resin-filled type carrier core material relevant to the present invention has a true density of desirably 3.0 to 5.5 g/cm$^3$, more desirably 4.0 to 5.5 g/cm$^3$. With the true density of less than 3.0 g/cm$^3$, the true density of the carrier after resin filling is excessively reduced, leading to a decreased charging speed and an excessively decreased magnetization per particle, then causing the carrier adhesion. With the true density of more than 5.5 g/cm$^3$, even if a resin is filled, a desired true density cannot be obtained, not achieving an elongated life.

A resin-filled type carrier core material relevant to the present invention has an apparent density of desirably 0.7 to 2.5 g/cm$^3$, more desirably 0.9 to 2.3 g/cm$^3$, most desirably 1.2 to 2.0 g/cm$^3$. With the apparent density of less than 0.7 g/cm$^3$, the strength becomes low possibly due to its bad shape, and the carrier becomes liable to be easily broken. With the apparent density of more than 2.5 g/cm$^3$, even if a resin is filled, an elongated life is hardly achieved.

A resin-filled type carrier core material relevant to the present invention has an average particle size of desirably 15 to 80 μm, more desirably 20 to 60 μm, most desirably 20 to 40 μm. With the average particle size of less than 15 μm, the carrier adhesion becomes undesirably liable to occur. With the apparent density of more than 80 μm, the image quality becomes undesirably liable to be deteriorated.

A ferrite core material for a resin-filled type carrier relevant to the present invention has a resistance of desirably $10^2$ to $10^{12}\Omega$, more desirably $10^3$ to $10^{11}\Omega$, most desirably $10^4$ to $10^{10}\Omega$. With the resistance of less than $10^2\Omega$, even if a resin is filled, the charge leak becomes liable to occur, undesirably generating image faults such as white spots. With the resistance of more than $10^{12}\Omega$, the resistance becomes excessively high when a resin is filled, undesirably hardly providing an image density.

A resin-filled type carrier core material relevant to the present invention has a magnetization of desirably 20 to 90 emu/g (A·m$^2$/kg), further desirably 25 to 75 emu/g (A·m$^2$/kg), most desirably 30 to 70 emu/g (A·m$^2$/kg). The magnetization of less than 20 emu/g (A·m$^2$/kg) is liable to induce the carrier adhesion. The magnetization of more than 90 emu/g (A·m$^2$/kg) heightens bristles of magnetic brushes, undesirably hardly providing high-quality images.

A resin-filled type carrier core material relevant to the present invention is composed desirably of a ferrite, more desirably one expressed by the general formula $(MO)_x(Fe_2O_3)_y$ (wherein, y is 30 to 95 mol %). Wherein, M is desirably one or more selected from the group consisting of Fe, Mn, Mg, Sr, Ca, Ti, Cu, Zn, Ni, Li, Al, Si, Zr and Bi.

Here, when M is Fe, the ferrite denotes iron ferrite, i.e., magnetite. Ferrites are oxides of higher order as compared with magnetite, and have hardly changing characteristics by stress. Further, a low specific gravity is easily achieved. With $Fe_2O_3$ of less than 30 mol %, a desired magnetization is difficult to obtain, and the carrier adhesion is liable to occur. Especially, a ferrite made of a specific metal oxide raw material has little variation in compositions between the particles, and easily provides desired characteristics. When the above elements are used, a resin is easily filled as compared with other elements, though the reason has not been clarified.

Taking into consideration the current of the environmental load reduction including recent years' waste regulations, the heavy metals of Cu, Zn and Ni preferably are not substantially contained.

From the above reasons, M is preferably one or more selected from the group consisting of Mn, Mg, Sr, Ca, Ti, Li, Al, Si, Zr and Bi, and especially preferably one or more selected from the group consisting of Mn, Mg, Sr, Ca, Li, Zr and Bi.

A resin-filled type carrier core material composed of a ferrite relevant to the present invention has a sintered primary particle size of desirably 0.2 to 10 μm, more desirably 0.2 to 7 μm, most desirably 0.2 to 5 μm. With the sintered primary particle size of less than 0.2 μm, since the sintering degree of the core material is too low, the carrier is liable to be broken during use, and part of it is liable to drop off. With the sintered primary particle size of more than 10 μm, since the sintering degree is too high, a resin is hardly filled; the filled resin is non-uniform; and a desired filling amount cannot be filled, thereby hardly providing a desired strength and low specific gravity.

A resin-filled type carrier core material composed of a ferrite relevant to the present invention has a ratio of a volume average particle size to the sintered primary particle size (volume average particle size/sintered primary particle size) of desirably 5 to 200, more desirably 8 to 150, most desirably 10 to 150. With the above ratio of more than 200, the grain size is small, and part of it is liable to drop off during use. With the above ratio of less than 5, since the sintering degree is too high, a resin is hardly filled; the filled resin is non-uniform; and a desired filling amount cannot be filled, thereby hardly providing a desired strength and low specific gravity.

<A Resin-Filled Type Carrier Relevant to the Present Invention>

A resin-filled type carrier relevant to the present invention has a resin filling amount of 6 to 30 wt. %, desirably 8 to 25 wt. %, further desirably 10 to 25 wt. %. The resin filling amount of less than 6 wt. % can hardly achieve a low specific gravity and hardly provide the effect on the elongated life. With the resin filling amount of more than 30 wt. %, since the carrier resistance becomes too high, the image density is hardly obtained, and as the case may be, the free resin other than the filled and coated resin is generated, thus becoming liable to cause image faults.

A resin-filled type carrier relevant to the present invention has a void fraction, i.e., the part present as voids not filled with a resin, of desirably 1 to 50%, more desirably 1.5 to 40%, most desirably 1.5 to 30%. Even if the resin is fully filled, the void of 1% or more is present. By filling the resin in the vicinity of the surface and leaving the voids inside as much as possible, the low specific gravity is easily obtained without making the carrier of extremely high resistance. However, if the void fraction of more than 50% is left, the carrier strength is liable to decrease, and the carrier is liable to be broken during use.

A resin-filled type carrier relevant to the present invention has a ratio of a resin-filled area rate to a core material area rate (a resin-filled area rate/a core material area rate) of desirably 0.20 to 0.80, more desirably 0.30 to 0.75, most desirably 0.40 to 0.70. With the above ratio of less than 0.20, the resin-filled part in the core material is too little, and the carrier mechanical strength has a tendency of being decreased. With the above ratio of more than 0.80, the charge accumulation is easily accelerated, generating excessive rises of charging during the use period, thereby hardly providing a stable image quality over a long period.

A resin-filled type carrier relevant to the present invention has a true density after resin filling of desirably 2.50 to 4.50 g/cm$^3$. The true density of less than 2.50 g/cm$^3$ sometimes brings about an excessive decrease in charging speed possibly due to too low specific gravity. The true density exceeding 4.50 g/cm$^3$ does not provide the effect of the low specific gravity, sometimes not achieving the elongated life.

A resin-filled type carrier relevant to the present invention has a ratio of the true density after resin filling to the true density of the core material (the true density after resin filling/the true density of the core material) of desirably 0.50 to 0.90, further desirably 0.65 to 0.90, most desirably 0.70 to 0.85. With the true density ratio of less than 0.50, the magnetization one particle has excessively decreases, easily generating the carrier adhesion, worsening the mixability with a toner, and easily generating the toner scattering and fogging in images because of the decrease in charging speed. The ratio exceeding 0.90 cannot provide the resin filling effect, hardly achieving the elongated life.

A resin-filled type carrier relevant to the present invention has an average particle size of desirably 15 to 80 μm, further desirably 20 to 60 μm, most desirably 20 to 40 μm. The average particle size of less than 15 μm unfavorably generates easily the carrier adhesion. By contrast, the average particle size exceeding 80 μm is unfavorably liable to deteriorate the image quality.

A resin-filled type carrier relevant to the present invention has a magnetization of desirably 20 to 90 emu/g ($A \cdot m^2/kg$), further desirably 25 to 75 emu/g ($A \cdot m^2/kg$), most desirably 30 to 70 emu/g ($A \cdot m^2/kg$). The magnetization of less than 20 emu/g ($A \cdot m^2/kg$) becomes liable to induce the carrier adhesion, and the magnetization exceeding 90 emu/g ($A \cdot m^2/kg$) heightens bristles of magnetic brushes, unfavorably hardly providing high-quality images.

A resin-filled type carrier relevant to the present invention has an electric resistance of desirably $10^5$ to $10^{15}\Omega$, further desirably $10^8$ to $10^{14}\Omega$, most desirably $10^9$ to $10^{13}\Omega$. The electric resistance of less than $10^5$ easily generates the charge leak, unfavorably generating image faults such as white spots. The electric resistance exceeding $10^{15}\Omega$ unfavorably hardly provides the image density.

A resin used in the resin-filled type carrier relevant to the present invention can be suitably selected depending on a toner to be combined with, the environment in use and the like. The filling resin is not especially limited, but includes, for example, a fluororesin, acrylic resin, epoxide resin, polyamide resin, polyamideimide resin, polyester resin, unsaturated polyester resin, urea resin, melamine resin, alkyd resin, phenol resin, fluoroacrylic resin, acryl-styrene resin, silicone resin, and a modified silicone resin modified by an acrylic resin, polyester resin, epoxide resin, polyamide resin, polyamideimide resin, alkyd resin, urethane resin, fluororesin or the like. Taking into consideration the drop-off of the resin by the mechanical stress during use, a thermosetting resin is preferably used. The thermosetting resin specifically includes an epoxide resin, phenol resin, silicone resin, unsaturated polyester resin, urea resin, melamine resin, alkyd resin, and a resin containing these.

In the above filling resin, a charge control agent can be contained. The charge control agent includes, for example, various kinds of charge control agents generally used for toners and various kinds of silane coupling agents. This is because, although the charging capability is sometimes reduced when the electric resistance has became relatively high through resin filling, it can be controlled by adding the charge control agent or the silane coupling agent. The usable charge control agent and coupling agent is not especially limited, but preferably a charge control agent such as a nigrosin dye, quaternary ammonium salt, organic metal complex or metal-containing monoazo dye, an aminosilane coupling agent, a fluorinated silane coupling agent, and the like.

For the purpose of controlling the resistance, charge quantity and charging speed of the resin-filled type carrier, a conductive agent can be added in a resin to be filled. Since too much addition of the conductive agent causes a sharp charge leak because of the low resistance of the conductive agent itself, the addition amount is 0.25 to 20.0 wt. % with respect to the solid content of the filling resin, preferably 0.5 to 15.0 wt. %, especially preferably 1.0 to 10.0 wt. %. The conductive agent includes a conductive carbon, an oxide such as titanium oxide or tin oxide, and various kinds of organic conductive agents.

For the purpose of enhancing the durability of a resin-filled type carrier relevant to the present invention and providing the stable image characteristics thereof over a long period, it is preferable that a resin be further coated on the surface of the carrier after resin filling described above. As the coating resin, common resins all are applicable.

Such a coating resin includes, for example, fluororesin, acrylic resin, epoxide resin, polyamide resin, polyamideimide resin, polyester resin, unsaturated polyester resin, urea resin, melamine resin, alkyd resin, phenol resin, fluoroacrylic resin, acryl-styrene resin, silicone resin, and modified silicone resin modified by acrylic resin, polyester resin, epoxide resin, polyamide resin, polyamideimide resin, alkyd resin, urethane resin, fluororesin or the like.

Taking into consideration dropping-off of the resin by the mechanical stress during use, the resin is preferably a resin of a similar kind to an above filling resin, a resin easily wettable with a filling resin, or a resin chemically bondable with a filling resin, and more preferably a resin having a low surface energy to prevent the toner fusion. The low surface energy resin includes, for example, a fluororesin, silicone resin and a resin containing these.

The surface coating thickness of the coating resin is desirably 0.01 to 7 μm, more desirably 0.05 to 5 μm, most desirably 0.1 to 3.5 μm. With the surface coating thickness of less than 0.01 μm, the charge is liable to leak from the core material exposed on the surface, and image faults become liable to occur. With the surface coating thickness exceeding 7 μm, the carrier is liable to be of high resistance; the charge is liable to be accumulated; and the fluidity of the carrier is worsened, thereby hardly providing desired high-quality images.

The coating amount of the resin is preferably 0.01 to 10.0 wt. % with respect to the carrier after resin filling, more preferably 0.3 to 7.0 wt. %, most preferably 0.5 to 5.0 wt. %. The coating amount of less than 0.01 wt. % hardly provides a uniform coating layer on the carrier surface, and the coating amount exceeding 10.0 wt. % generates aggregation of carriers, causing decrease in productivity including yield, and variations in developer characteristics such as fluidity and charge quantity in actual machines.

In the above coating resin, a charge control agent can be contained. The charge control agent includes, for example, various kinds of charge control agents commonly used for toners, and various kinds of silane coupling agents. This is because, although the charging capability sometimes decreases when the core material-exposed area is controlled by coating so as to be made relatively small, it can be controlled by addition of a charge control agent or silane coupling agent. The kind of a usable charge control agent and silane coupling agent is not especially limited, but is preferably a charge control agent such as a nigrosin dye, quaternary ammonium salt, organic metal complex or metal-containing monoazo dye, an aminosilane coupling agent, a fluorinated silane coupling agent, and the like.

In the above coating resin, a conductive agent can also be added. This is because, when the resin coating amount is controlled by coating so as to be made relatively much, the absolute resistance becomes too high, sometimes resulting in decrease in developing capability. However, since too much addition amount of a conductive agent causes a sharp charge leak because of the low resistance the conductive agent itself has as compared with the coating resin and the ferrite as the core material, the addition amount is preferably 0.25 to 20.0 wt. % with respect to the solid content of the coating resin, preferably 0.5 to 15.0 wt. %, especially preferably 1.0 to 10.0 wt. %. The conductive particle includes a conductive carbon, an oxide such as titanium oxide or tin oxide, and various kinds of organic conductive agents.

<Measuring Methods>

The measuring method of each physical property of the above ferrite core material for the resin-filled type carrier and the above resin-filled type carrier relevant to the present invention will be described below.

(Void Fraction)

The void fraction of a resin-filled type carrier is obtained by taking images of cross-sections of a carrier core material by a metallurgical microscope, a scanning electron microscope, etc., and analyzing the obtained images by using an image analyzing software (Image-Pro Plus, produced by Media Cybernetics Inc.). Concretely, the particle area (A) surrounded by lines enveloping the unevenness of the surface of a core material particle is measured, and the area (B) of the core material part contained in the particle image is then measured. The void fraction is calculated by using the following expression.

Void fraction (%)=(enveloped particle area (*A*)−core material area (*B*))/enveloped particle area (*A*)×100

The void fraction calculated by this expression denotes a void fraction from the sum of voids continuing from the core material surface and voids independently present inside the core material.

(True Density)

The true densities of a carrier core material and carrier particles after resin filling are measured according to JIS R9301-2-1 by using a picnometer.

(Continuous Void Degree)

The continuous void degree denotes a volume of voids continuing from the particle surface, and is let be an absorbed oil amount measured using a silicone oil. Concretely, a ferrite core material (powder) of 10 g is weighed on a glass plate; and a linear methyl-based silicone oil of about 100 cs in viscosity (KF-96-100cs, manufactured by Shin-Etsu Chemical Co., Ltd.) is little by little dropped on the specimen center, and fully kneaded as a whole with a spatula at every dropping. The operations of the dropping and kneading are repeated; and a continuous void degree is let be the addition amount when the powder as a whole is unified into one, i.e., pelletized. The larger value of this shows that the ferrite core material has a more impregnation capability for a resin. An oil absorbing amount of the specimen, i.e., a continuous void degree is let be a dropping amount (g) to the specimen of 10 g.

(Core Material Area Rate, Resin-Filled Area Rate, and Void Fraction After Resin Filling)

Images of the cross-sections of a carrier are taken by a metallurgical microscope, a scanning electron microscope, etc. The obtained images are rendered to be images of only particles by using an image analyzing software (Image-ProPlus, produced by Media Cybernetics Inc.), and then divided into core material parts, void parts and resin-filled parts, whereby respective areas are measured. The respective areas are calculated for every particle, and the core material area, void area and resin-filled area are let be respective average values of 50 particles. Each area rate and the void fraction after resin filling are determined by the following expression.

Core material area rate (%)=core material area/(core material area+resin-filled area+void area)×100

Resin-filled area rate (%)=resin-filled area/(core material area+resin-filled area+void area)×100

Void fraction after resin filling (%)=void area/(core material area+resin-filled area+void area)×100

(Apparent Density)

The apparent density is measured according to JIS Z2504 (Metallic powders-Determination of apparent density).

(Average Particle Size)

The average particle size is measured using a Microtrac Particle Size Analyzer (Model: 9320-X100), manufactured by Nikkiso Co., Ltd.

(Magnetic Property)

The magnetization is measured using an integral-type B-H tracer BHU-60 (manufactured by Riken Denshi Co., Ltd.). An H coil for measuring magnetic field and a 4πI coil for measuring magnetization are put in between electromagnets. In this case, a sample is put in the 4πI coil. Outputs of the H coil and the 4πI coil when the magnetic field H is changed by changing the current of the electromagnets are each integrated; and with the H output as the X-axis and the 4πI coil output as the Y-axis, a hysteresis loop is drawn on a chart. The measurement is conducted under the conditions of the sample filling quantity: about 1 g, the sample filling cell: inner diameter of 7 mmϕ±0.02 mm, height of 10 mm±0.1, and 4πI coil: winding number of 30.

(Observation of Shape, Surface Property, and Resin Filling State)

The shape and surface property of carrier particles are observed and confirmed using a scanning electron microscope (JSM-6100, manufactured by JEOL Ltd.). The resin filling state is observed by taking cross-section photographs of the carrier by the above scanning electron microscope. Here, the sintered primary particle size is determined by selecting one representative particle from the photographs taken by the above electron microscope, and calculating the average of a maximum and a minimum sintered primary particle sizes in the particle.

(Charge Property)

The charge quantity is measured using a mixture of a carrier and a toner by a suction type charge measurement device (Epping q/m-meter, manufactured by PES-Laboratorium). As the toner, a negative polarity toner commercially available for full-color printers (cyan toner for DocuPrint C3530, produced by Fuji Xerox Co., Ltd.) is used by adjusting the toner concentration to 7 wt. %. The true density of the toner is 1.05 g/cm$^2$ as a result of the measurement.

Now, the initial charge quantity is let be a charge quantity after agitation of one minute with the toner; and the saturated charge quantity is let be a charge quantity after the agitation of 10 minutes. The smaller difference between the initial charge quantity and the saturated charge quantity means a higher charging speed, and a rapid mixing with the supplied toner in practical uses.

Further, the charge quantity after stress is let be a charge quantity after the agitation of 36 hours. This is to confirm weather or not the charge quantity varies by a long period agitation stress, and the charge quantity nearer to the initial charge quantity and the saturated charge quantity means a more stable charge property.

(Electric Resistance)

With an N pole and an S pole facing each other with a gap of 6.5 mm between the magnetic poles, a sample of 200 mg is weighed and inserted between non-magnetic parallel flat electrodes (10 mm×40 mm). The sample is held between the parallel flat electrodes by attaching the magnetic poles (the surface magnetic flux density: 1,500 Gauss, the facing electrode area: 10 mm×30 mm) to the electrodes. Then, the resistance at an applied voltage of 100 V is measured using an insulation resistance meter.

(Carrier Strength)

The strength of a carrier is measured according to JIS K1474 (Test methods for activated carbon), as follows.

A sample of 50 g and steel balls of 5 mm and 12 mm in diameter each of 30 balls are put in a test dish, and shaken for 20 minutes by a sieve shaker. Thereafter, the sample and the steel balls are divided, and the average particle size of the sample is measured. The changing rate in average particle size using the average particle sizes before and after shaking is calculated by the below expression, and a carrier strength is let be the strength. A small strength means the carrier has been broken, and can be said to be a weak one.

$$\text{Strength (\%)} = (\text{an average particle size after shaking}/(\text{an average particle size before shaking}) \times 100$$

(Toner Breakage State)

The shape of the toner after the agitation of 36 hours described above is observed and confirmed by a scanning electron microscope (JSM-6100, manufactured by JEOL Ltd.).

(Toner Spent)

A carrier is sampled from the developer after the agitation of 36 hours, and observed by a scanning electron microscope (JSM-6100, produced by JEOL Ltd.), and the toner amount fused to the carrier surface is also measured.

(Scattering Amount)

On a cylindrical sleeve having a region having a peak magnetic flux density of 100 mT in the direction perpendicular to the axis, the carrier or resin-filled carrier is magnetically held; only the magnetic pole region having the peak magnetic flux density is opened; the cylindrical sleeve is rotated for 10 minutes to impart to the carrier a leaving force three times the gravity force in the direction perpendicular to the rotation axis; and the scattering amount is let be an amount which has left the opening portion. A much scattering amount means that the carrier easily leaves a magnet roll in practical uses, and results in generating troubles such as flawing of a photoreceptor by the carrier scattering and occurrence of white spots. The scattering amount is preferably 50 mg or less, more preferably 30 mg or less, especially preferably 10 mg or less.

<Producing Methods for a Ferrite Core Material for a Resin-Filled Type Carrier and the Resin-Filled Type Carrier Relevant to the Present Invention>

Then, producing methods of a ferrite core material for a resin-filled type carrier relevant to the present invention will be explained.

For producing a ferrite core material for a carrier of the present invention, raw materials are appropriately weighed, and then crushed and mixed by a ball mill, vibration mill or the like for 0.5 hours or more, preferably for 1 to 20 hours. The crushed material thus obtained is pelletized using a pressure molding machine or the like, and calcined at a temperature of 700 to 1,200° C. After crushing, without using a pressure molding machine, it may be added with water and made into a slurry, and granulated using a spray drier. The calcined material is further crushed by a ball mill, vibration mill or the like, and then added with water, optionally with a dispersant, a binder, etc., adjusted for its viscosity, granulated, and held and sintered at a temperature of 1,000 to 1,500° C. for 1 to 24 hours while the oxygen concentration is controlled. In the case of crushing after calcination, the calcined material may be added with water and crushed by a wet ball mill, wet vibration mill or the like.

The above crushing machine such as the ball mill or vibration mill is not especially limited, but, for uniformly and effectively dispersing the raw materials, preferably uses fine beads having a particle size of 1 mm or less as a media to be used. By adjusting the size, composition and crushing time of the using beads, the crushing degree can be controlled.

The sintered material thus obtained is crushed, and classified and adjusted into desired particle sizes using existing methods including the air classification, mesh filtration method and precipitation method.

Thereafter, the electric resistance can be optionally adjusted by performing the oxide film treatment by heating the surface at a low temperature. The oxide film treatment is performed using common furnaces such as a rotary electric furnace or batch-type electric furnace, and the heat-treatment is performed, for example, at 300 to 700° C. The thickness of the oxide film formed by this treatment is preferably 0.1 nm to 5 μm. If less than 0.1 nm, the effect of the oxide film is unfavorably little. If more than 5 μm, the magnetization sometimes decreases, and an excessively high resistance is sometimes provided, then unfavorably hardly providing desired characteristics. The reduction may optionally be performed before the oxide film treatment.

Methods for controlling the void fraction, continuous void degree, apparent density and true density of a ferrite core material for a resin-filled type carrier as described above involve kinds of raw material to be formulated, crushing degrees of raw materials, presence/absence of calcination, calcination temperatures, calcination times, binder amounts at granulation by a spray drier, water amounts, drying degrees, sintering methods, sintering temperatures, sintering times, crushing methods, reduction by hydrogen, and others. The controlling methods are not especially limited, but will be exemplified below.

That is, use of hydroxides and carbonates as raw materials to be formulated easily provides a high void fraction and continuous void degree as compared with use of oxides. Use of oxides of Mn, Mg, Ca, Sr, Li, Ti, Al, Si, Zr, Bi, etc., as raw materials easily provides a low true density and apparent density as compared with use of oxides of heavy metals, Cu, Ni and Zn.

No calcination provides a higher void fraction and continuous void degree, and a lower apparent density. The calcination, when performed, at a lower temperature is apt to provide a higher void fraction and continuous void fraction, and a lower apparent density.

In the granulation by a spray drier, a more water amount when raw materials are made into a slurry is apt to provide more voids, a higher void fraction and continuous void degree, and a lower apparent density; and a lower sintering temperature is apt to provide a higher void fraction and continuous void degree, and a lower apparent density.

For obtaining a desired void fraction, continuous void degree, true density and apparent density, these controlling methods can be used alone or in combination. High void fractions and continuous void degree generally have a tendency of having low true densities and apparent densities.

However, since the influencing degree of controlling factors on the properties varies, by using these in combination, carrier core materials composed of a ferrite having properties such as a high void fraction and a high apparent density or such as a low void fraction and a low density can be obtained.

The most favorable constitution is preferably a carrier core material which has, for satisfying all of the agitation property with a toner, the magnetization per one particle and the elongated life, such combined properties as a high void fraction, a high continuous void degree, a high apparent density, a low true specific gravity, and a high fluidity, as have not conventionally been achieved simultaneously because they conflict with each other, and can be achieved by controlling a number of the methods described above in combination.

As a method for filling the core material for a resin-filled type carrier thus obtained with a resin, various methods are usable. The methods include, for example, the dry process method, the spray-dry system by a fluidized bed, the rotary-dry system, the liquid immersion-dry method by a universal agitator, etc. A suitable method is selected from these methods depending on a core material and a resin to be used.

After the resin is filled, heating is performed optionally by various kinds of systems to tightly adhere the filled resin to the core material. As the heating system, either of an external heating system and an internal heating system can be used, and, for example, a fixed-type or flow-type electric furnace, a rotary electric furnace, a burner furnace, or the microwave can be used for baking. The temperatures are different depending on the filling resins, and a temperature of not less than the melting point or the glass transition temperature is needed. For a thermosetting resin, a condensation-crosslinkable resin or the like, the temperature is raised to full curing, whereby a resin-filled type carrier strong in impact can be obtained.

Methods for further coating a resin as described above on the carrier after resin filling described above involve coating by a well-known method, for example, the brush coating method, dry process method, spray-dry system by a fluidized bed, rotary-dry system and liquid immersion-dry method by a universal agitator. For improving the coating rate, the method by a fluidized bed is preferable.

For baking the resin after the resin is coated on the carrier core material, either of an external heating system and an internal heating system can be used, and, for example, a fixed-type or flow-type electric furnace, a rotary electric furnace, a burner furnace, or the microwave can be used for baking. When a UV-curing resin is employed, a UV heater is used. The temperatures are different depending on the coating resins, and a temperature of not less than the melting point or the glass transition temperature is needed. For a thermosetting resin, a condensation-crosslinkable resin or the like, the temperature needs to be raised to full curing.

<An Electrophotographic Developer Relevant to the Present Invention>

Next, an electrophotographic developer relevant to the present invention will be explained.

A toner particle constituting a developer of the present invention involves a pulverized toner particle produced by the pulverizing method, and a polymerized toner particle produced by the polymerizing method. In the present invention, the toner particle obtained by either of them can be used.

The pulverized toner particle can be obtained, for example, by fully mixing a binding resin, a charge control agent and a colorant by a mixer such as a Henschel mixer, then melting and kneading by a biaxial extruder, etc., cooling, pulverizing, classifying, adding with additives, and thereafter mixing by a mixer, etc.

The binding resin constituting the pulverized toner particle is not especially limited, but includes a polystyrene, chloropolystyrene, styrene-chlorostyrene copolymer, styrene-acrylate copolymer, styrene-methacrylate copolymer, and further, a rosin-modified maleic acid resin, epoxide resin, polyester resin and polyurethane resin. These are used alone or by mixing.

As the charge control agent, an optional one can be used. One for a positively chargeable toner includes, for example, a nigrosin dye and a quaternary ammonium salt, and one for a negatively chargeable toner includes, for example, a metal-containing monoazo dye.

As the colorant (coloring material), conventionally known dyes and pigments are usable. For example, carbon black, phthalocyanine blue, permanent red, chrome yellow, phthalocyanine green and the like can be used. Otherwise, additives such as a silica powder and titania for improving the fluidity and cohesion resistance of the toner can be added corresponding to the toner particle.

The polymerized toner particle is one produced by a conventionally known method such as the suspension polymerization method, emulsion polymerization method, emulsion coagulation method, ester extension method and phase transition emulsion method. Such a toner particle by the polymerization methods is obtained, for example, by mixing and agitating a colored dispersion liquid in which a colorant is dispersed in water using a surfactant, a polymerizable monomer, a surfactant and a polymerization initiator in an aqueous medium, emulsifying and dispersing the polymerizable monomer in the aqueous medium, and polymerizing while agitating and mixing. Thereafter, the polymerized dispersion is added with a salting-out agent, and the polymerized particle is salted out. The particle obtained by the salting-out is filtrated, washed and dried to obtain the polymerized toner particle. Thereafter, the dried toner particle is optionally added with an additive.

Further, on producing the polymerized toner particle, a fixability improving agent and a charge control agent can be blended other than the polymerizable monomer, surfactant, polymerization initiator and colorant, thus allowing to control and improve various properties of the polymerized toner particle obtained using these. Besides, for improving the dispersibility of the polymerizable monomer in the aqueous medium, and adjusting the molecular weight of the obtained polymer, a chain-transfer agent can be used.

The polymerizable monomer used for the production of the above polymerized toner particle is not especially limited, but includes, for example, styrene and its derivatives, ethylenic unsaturated monoolefins such as ethylene and propylene, halogenated vinyls such as vinyl chloride, vinyl esters such as vinyl acetate, and $\alpha$-methylene aliphatic monocarboxylate, such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used for preparing the above polymerized toner particle, conventionally known dyes and pigments are usable. For example, carbon black, phthalocyanine blue, permanent red, chrome yellow and phthalocyanine green can be used. The surface of colorants may be improved by using a silane coupling agent, a titanium coupling agent and the like.

As the surfactant used for the production of the above polymerized toner particle, an anionic surfactant, a cationic surfactant, an amphoteric surfactant and a nonionic surfactant can be used.

Here, the anionic surfactants include sodium oleate, a fatty acid salt such as castor oil, an alkylsulfate such as sodium laurylsulfate and ammonium laurylsulfate, an alkylbenzenesulfonate such as sodium dodecylbenzenesulfonate, an alkylnaphthalenesulfonate, an alkylphosphate, a naphthalenesulfonic acid-formalin condensate, a polyoxyethylene alkylsulfate, etc. The nonionic surfactants include a polyoxyethylene alkyl ether, a polyoxyethylene aliphatic acid ester, a sorbitan aliphatic acid ester, a polyoxyethylenealkyl amine, glycerin, an aliphatic acid ester, an oxyethylene-oxypropylene block polymer, etc. Further, the cationic surfactants include alkylamine salts such as laurylamine acetate, and quaternary ammonium salts such as lauryltrimethylammonium chloride, stearyltrimethylammonium chloride, etc. Then, the amphoteric surfactants include an aminocarbonate, an alkylamino acid, etc.

A surfactant as above is generally used in an amount within the range of 0.01 to 10 wt. % with respect to a polymerizable monomer. Since the use amount of such a surfactant affects the dispersion stability of the monomer, and affects the environmental dependability of the obtained polymerized toner particle, it is preferably used in the amount within the above range where the dispersion stability of the monomer is secured, and the polymerized toner particle does not excessively affect the environmental dependability.

For the production of the polymerized toner particle, a polymerization initiator is generally used. The polymerization initiators come in a water-soluble polymerization initiator and an oil-soluble polymerization initiator, and both of them can be used in the present invention. The water-soluble polymerization initiator used in the present invention includes, for example, a peroxosulfate salt such as potassium peroxosulfate, and ammonium peroxosulfate, and a water-soluble peroxide compound. The oil-soluble polymerization initiator includes, for example, an azo compound such as azobisisobutyronitrile, and an oil-soluble peroxide compound.

In the case where a chain-transfer agent is used in the present invention, the chain-transfer agent includes, for example, mercaptans such as octylmercaptan, dodecylmercaptan and tert-dodecylmercaptan, carbon tetrabromide, etc.

Further, in the case where a polymerized toner particle used in the present invention contains a fixation improving agent, as the fixation improving agent, a natural wax such as a carnauba wax, and an olefinic wax such as a polypropylene and a polyethylene can be used.

In the case where a polymerized toner particle used in the present invention contains a charge control agent, the charge control agent to be used is not especially limited, and a nigrosine dye, a quaternary ammonium salt, an organic metal complex, a metal-containing monoazo dye and the like can be used.

The additive used for improving the fluidity etc. of a polymerized toner particle includes silica, titanium oxide, barium titanate, fluorine resin microparticles, acrylic resin microparticles, etc., and these can be used alone or in combination thereof.

Further, the salting-out agent used for separating a polymerized particle from an aqueous medium includes metal salts such as magnesium sulfate, aluminum sulfate, barium chloride, magnesium chloride, calcium chloride and sodium chloride.

The average particle size of the toner particle produced as above is in the range of 2 to 15 μm, preferably in the range of 3 to 10 μm. The polymerized toner particle has the higher uniformity than the pulverized toner particle. The toner particle of less than 2 μm decreases the electrification capability and is apt to bring about the fogging of image and toner scattering. That exceeding 15 μm causes the degradation of image quality.

By mixing the carrier and the toner produced as above, an electrophotographic developer is obtained. The mixing ratio of the carrier to the toner, namely, the toner concentration, is preferably set to be 3 to 15%. With less than 3%, a desired image density is hard to obtain. With more than 15%, the toner scattering and fogging of image are apt to occur.

In the electrophotographic developer relevant to the present invention, the ratio of a true density of a toner to a true density of a carrier (a true density of a toner/a true density of a carrier) is desirably 1/5 to 1/2, further desirably 1/5 to 2/5, most desirably 2/9 to 1/3. With the true density of less than 1/5, the specific gravity difference between a toner and a carrier is large, and the toner is liable to deteriorate by agitation stress with the carrier, unfavorably easily changing the charge properties. With the true density exceeding 1/2, mixability of a toner and a carrier is worsened, and the charge properties are deteriorated, easily generating toner scattering and fogging of images.

The electrophotographic developer relevant to the present invention mixed as above can be used in copying machines, printers, FAXs, printing presses and the like, in the digital system, which use the development system in which electrostatic latent images formed on a latent image holder having an organic photoconductor layer are reversal-developed by magnetic brushes of the two-component developer having the toner and the carrier while impressing a bias electric field. It is also applicable to full-color machines and the like which use an alternating electric field, which is a method to superimpose an AC bias on a DC bias, when the developing bias is applied from magnetic brushes to the electrostatic latent image side.

Hereinafter, the present invention will be specifically explained by way of examples.

EXAMPLE 1

Example 1a

Raw materials were weighed so as to become MnO: 35 mol %, MgO: 14.5 mol %, $Fe_2O_3$: 50 mol % and SrO: 0.5 mol %, mixed with water, and then crushed by a wet media mill for 5 hours to obtain a slurry. The obtained slurry was dried by a spray drier to obtain spherical particles. For adjusting the void fraction and continuous void degree, manganese carbonate as the MnO raw material and magnesium hydroxide as the MgO raw material were used. The particles were adjusted for the particle size, and heated at 950° C. for 2 hours for calcination. Then, for obtaining a suitable fluidity with a comparatively high void fraction, the calcined material was crushed for one hour by a wet ball mill using stainless beads of ⅛ inch in diameter, and further crushed for 4 hours using stainless beads of 1/16 inch in diameter. This slurry was added with a dispersant in an appropriate amount, and for the purpose of securing the strength of particles to be granulated and adjusting the void fraction and continuous void degree, is added as a binder with PVA of 1 wt. % with respect to the solid content, then granulated and dried by a spray drier, and held and sintered at a temperature of 1,100° C. at an oxygen concentration of 0 vol % for 4 h in an electric furnace. Thereafter, the sintered material was crushed, further classified for particle size adjustment, and then low magnetic particles were fractionated by the magnetic separation to obtain a core material of ferrite particles. An electron microscopic photograph of the core material of the ferrite particles is shown in FIG. 1.

Example 1b

A core material of ferrite particles was obtained as in Example 1a, but using trimanganese tetraoxide instead of manganese carbonate, the binder to be added of 0.8 wt. %, and zirconia beads of 0.5 mm instead of stainless beads of 1/16 inch in diameter, and holding and sintering at a temperature of 1,150° C. at an oxygen concentration of 0.5 vol % for 4 hours in an electric furnace.

Example 1c

A core material of ferrite particles was obtained as in Example 1a, but using manganese dioxide instead of manganese carbonate, and the binder to be added of 0.5 wt. %, and holding and sintering at a temperature of 1,200° C. at an oxygen concentration of 1.5 vol % for 4 hours in an electric furnace.

Comparative Example 1a

A ferrite core material was the porous CuZn ferrite (an average particle size of 32 μm, a BET surface area of about 1,600 $cm^2/g$, manufactured by Powdertech Co., Ltd.) described in example of Japanese Patent Laid-Open No. 11-295933. Concretely, raw materials were weighed so as to become CuO: 20 mol %, ZnO: 25 mol % and $Fe_2O_3$: 55 mol %, added with a dispersant and a binder in suitable amounts, and crushed by a wet media mill for 5 h to obtain a slurry. The obtained slurry was dried by a spray drier to obtain spherical particles. The particles were adjusted for particle size, and then held and sintered in the atmosphere at about 1,200° C. for 4 hours so as to assume a BET area of about 1,600 $cm^2/g$. Thereafter, the sintered material was crushed, further adjusted for particle size so as to assume an average particle size of 32 μm, and then low magnetic particles were fractionated by the magnetic separation to obtain a core material of ferrite particles.

Comparative Example 1b

A core material of ferrite particles was obtained as in Example 1a, but with a calcination temperature of 1,100° C., a crushing time thereafter of 12 hours, and the sintering at 1,300° C. for 6 hours at an oxygen concentration of 2.5%.

Comparative Example 1c

The alkoxy-modified silicone (SR-2402, manufactured by Dow Corning Toray Co., Ltd.) of 100 pts·wt., γ-aminopropyltriethoxysilane of 15 pts·wt. and dibutyltin laurate of 4 pts·wt., and together magnetite fine particles of 300 pts·wt. whose particle size is adjusted into a volume average particle size of 0.75 μm were kneaded by a kneader to obtain a paste.

Calcium phosphate of 2 pts·wt. was dispersed in an ion exchange water of 20 pts·wt., added with the above paste of 1 pts·wt., and agitated for 2 minutes by a homogenizer. The suspension after agitation was heated at 80° C. for 2 hours, then cooled to 25° C., next added with hydrochloric acid to dissolve calcium phosphate, and filtrated to obtain a filtrated material. The obtained filtrated material was dried, cured at 80° C. for 2 hours, and then crushed to obtain magnetic powder-dispersed carrier particles.

Comparative Example 1d

Raw materials were weighed so as to become MnO: 20 mol % and $Fe_2O_3$: 80 mol %, and crushed by a dry media mill for 5 hours to obtain a crushed material. The obtained crushed material was molded into an average particle size of about 1 mm by a compression granulator. The obtained molded material was heated at 950° C. for 2 hours, and calcined. Then, the calcined material was crushed by an impact crusher, adjusted for particle size to obtain amorphous particles of an average particle size of 20 μm. The obtained amorphous particles were held and sintered at a temperature of 1,300° C. at an oxygen concentration of 0 vol % for 4 hours in an electric furnace. Thereafter, the sintered material was crushed, classified and adjusted for particle size, and then low magnetic particles were fractionated by the magnetic separation to obtain a core material of amorphous ferrite particles.

Comparative Example 1e

Raw materials were weighed so as to become MnO: 10 mol %, MgO: 39 mol %, $Fe_2O_3$: 50 mol % and SnO: 1 mol %, added with a dispersant and a binder in suitable amounts, and crushed by a wet media mill for 5 hours to obtain a slurry. The obtained slurry was dried by a spray drier to obtain spherical particles. The particles were adjusted for particle size, and then held and sintered in the atmosphere at about 1,250° C. for 4 hours. Thereafter, the sintered material was crushed and adjusted for particle size. The obtained particles were reduced at 480° C. for one hour using hydrogen in a batch reduction furnace, fully cooled over one hour, and taken out. Thereafter, the aggregated particles by the reduction treatment were loosened, again adjusted for particle size, then low magnetic particles were fractionated by the magnetic separation to obtain a core material of ferrite particles.

Comparative Example 1f

Raw materials were weighed so as to become SrO: 14.9 mol % and $Fe_2O_3$: 85.1 mol %, added with a dispersant and a binder in suitable amounts, and crushed by a wet media mill for 5 hours to obtain a slurry. The obtained slurry was dried by a spray drier to obtain spherical particles. The particles were adjusted for particle size, and then held and sintered in the atmosphere at about 1,280° C. for 4 hours. Thereafter, the sintered material was crushed and adjusted for particle size to obtain a core material of hard magnetic ferrite particles.

EXAMPLE 2

Example 2a

A filling resin solution was obtained by dissolving the condensation-crosslinkable silicone resin (SR-2411, manufactured by Dow Corning Toray Co., Ltd.) of 20 pts·wt. in terms of solid content and γ-aminopropyltriethoxysilane of 2 pts·wt. in toluene of 1,000 pts·wt. The ferrite core material obtained in Example 1a of 100 pts·wt. was put in a uniaxial indirect heating drier, and while held and agitated at 75° C., the above resin solution was dropped. After confirming that the toluene had fully volatilized, the temperature was raised to 200° C. while the agitation was continued, and held for 2 hours. Thereafter, the obtained particles were taken out, and the aggregated particles were loosened, and adjusted for particle size. Then, low magnetic particles were fractionated by the magnetic separation to obtain resin-filled carrier particles.

Example 2b

Resin-filled carrier particles were obtained as in Example 2a, but with a formulation amount of the silicone resin of 15 pts·wt. in terms of solid content.

Example 2c

Resin-filled carrier particles were obtained as in Example 2a, but with a formulation amount of the silicone resin of 13 pts·wt. in terms of solid content.

Example 2d

Resin-filled carrier particles were obtained as in Example 2c, but using the ferrite core material obtained in Example 1b.

Example 2e

Resin-filled carrier particles were obtained as in Example 2c, but using the ferrite core material obtained in Example 1c Comparative Example 2a A filling resin solution was obtained by dissolving the thermoplastic acrylic resin (BR-52, manufactured by Mitsubishi Rayon Co., Ltd.) of 5.5 pts·wt. in terms of solid content in toluene of 1,000 pts·wt. The ferrite core material obtained in Comparative Example 1a of 100 pts·wt. was put in a uniaxial indirect heating drier, held and agitated at 75° C., and the above resin solution was dropped. After confirming that the toluene had fully volatilized, the temperature was raised to 150° C. while the agitation was continued, and held for 2 hours. Thereafter, the obtained particles were taken out, and the aggregated particles were loosened, and adjusted for particle size. Then, low magnetic particles were fractionated by the magnetic separation to obtain carrier particles.

Comparative Example 2b

Carrier particles were obtained as in Comparative Example 2a, but using a formulation amount of the acrylic resin of 13 pts·wt. and the ferrite core material obtained in Comparative Example 1b.

Comparative Example 2c

The magnetic powder-dispersed carrier obtained in Comparative Example 1c was used as it was.

Comparative Example 2d

Carrier particles were obtained as in Comparative Example 2a, but using the amorphous ferrite core material obtained in Comparative Example 1d.

Comparative Example 2e

Carrier particles were obtained as in Comparative Example 2a, but using the ferrite core material obtained in Comparative Example 1e.

Comparative Example 2f

Carrier particles were obtained as in Comparative Example 2a, but using the ferrite core material obtained in Comparative Example 1f.

The core materials and resin-filled type carriers obtained as described above were evaluated for the characteristics by the methods described above. The results are shown in Table 1 and Table 2.

TABLE 1

| | Properties of core materials for resin filling | | | | | | |
|---|---|---|---|---|---|---|---|
| | Composition | Sintered primary particle size (μm) | Volume average size/sintered primary particle size | Void fraction (%) | Continuous void fraction | BET area ($cm^2/g$) | Fluidity (sec/50 g) |
| Example 1a | Mn—Mg—Sr based ferrite | 3.1 | 11.0 | 41.2 | 2.62 | 5201 | 46.2 |
| Example 1b | Mn—Mg—Sr based ferrite | 3.4 | 10.4 | 28.9 | 2.75 | 3095 | 44.3 |
| Example 1c | Mn—Mg—Sr based ferrite | 4.3 | 8.6 | 17.2 | 2.00 | 2138 | 38.3 |
| Comparative Example 1a | Cu—Zn ferrite | 5.2 | 6.2 | 8.6 | 1.45 | 1600 | 51.7 |
| Comparative Example 1b | Mn—Mg—Sr based ferrite | 8.1 | 4.4 | 3.3 | 1.38 | 1254 | 57.9 |
| Comparative Example 1c | Magnetic powder-dispersed type | — | — | 1.2 | 0.85 | Not measurable | Not measurable |
| Comparative Example 1d | Mn based ferrite | 7.5 | 2.8 | 2.7 | 1.48 | 1870 | Not measurable |
| Comparative Example 1e | Mn—Mg—Sn based ferrite | 5.7 | 6.1 | 9.1 | 1.59 | 2859 | 55.1 |
| Comparative Example 1f | Sr based ferrite | 3.1 | 6.1 | 7.5 | 1.61 | 1991 | Not measurable |

| | Properties of core materials for resin filling | | | | | |
|---|---|---|---|---|---|---|
| | True density ($g/cm^3$) | Apparent density ($g/cm^3$) | Volume average particle size (μm) | Residual magnetization ($A \cdot m^2/kg$) | Electric resistance (Ω) | Strength (%) |
| Example 1a | 4.85 | 1.72 | 34.2 | 2 | $7.1 \times 10^7$ | 95.5 |
| Example 1b | 4.86 | 1.63 | 35.4 | 1 | $7.5 \times 10^7$ | 98.8 |
| Example 1c | 4.88 | 1.99 | 36.9 | 1 | $7.6 \times 10^7$ | 99.1 |
| Comparative | 4.91 | 2.12 | 32.0 | 3 | $5.2 \times 10^{10}$ | 97.8 |

TABLE 1-continued

| | | | | | | |
|---|---|---|---|---|---|---|
| Example 1a | | | | | | |
| Comparative Example 1b | 4.83 | 2.15 | 35.9 | 2 | $2.6 \times 10^{10}$ | 93.4 |
| Comparative Example 1c | 2.32 | 0.96 | 22.3 | 12 | $1.2 \times 10^{14}$ | 57.8 |
| Comparative Example 1d | 4.91 | 1.75 | 20.9 | 3 | $3.9 \times 10^{3}$ | 81.4 |
| Comparative Example 1e | 4.81 | 1.94 | 34.8 | 4 | $4.8 \times 10^{9}$ | 85.5 |
| Comparative Example 1f | 4.94 | Not measurable | 18.9 | 32 | $4.8 \times 10^{8}$ | 86.3 |

TABLE 2

| | | | | Properties after resin filling | | | | | | |
|---|---|---|---|---|---|---|---|---|---|---|
| | Used core material | Filling resin | Filling amount (pts. wt.) | Void fraction (%) | Core material area rate (%) | Resin-filled area rate (%) | Resin-filled area rate/core material area rate | True density ($g/cm^3$) | True density ratio (after filling/core material) | Apparent density ($g/cm^3$) |
| Example 2a | Core material of Example 1a | Silicone resin | 20 | 2.6 | 58.1 | 39.3 | 0.68 | 3.38 | 0.70 | 1.60 |
| Example 2b | Core material of Example 1a | Silicone resin | 15 | 4.8 | 61.5 | 33.7 | 0.55 | 3.55 | 0.73 | 1.68 |
| Example 2c | Core material of Example 1a | Silicone resin | 13 | 7.3 | 64.0 | 28.7 | 0.45 | 3.72 | 0.77 | 1.73 |
| Example 2d | Core material of Example 1b | Silicone resin | 13 | 2.9 | 73.0 | 24.1 | 0.33 | 3.71 | 0.76 | 1.71 |
| Example 2e | Core material of Example 1c | Silicone resin | 13 | 1.1 | 82.4 | 16.5 | 0.20 | 3.82 | 0.78 | 1.69 |
| Comparative Example 2a | Core material of Comparative Example 1a | Acrylic resin | 5.5 | 1.3 | 92.5 | 6.2 | 0.07 | 4.52 | 0.92 | 2.01 |
| Comparative Example 2b | Core material of Comparative Example 1b | Acrylic resin | 13 | Not measurable | Not measurable | Not measurable | Not measurable | Not measurable | Not measurable | Not measurable |
| Comparative Example 2c | — | — | — | 1.2 | — | — | — | 2.32 | — | 0.96 |
| Comparative Example 2d | Core material of Comparative Example 1d | Acrylic resin | 5.5 | 2.3 | 96.3 | 1.4(*) | 0.01 | 4.53 | 0.92 | 1.36 |
| Comparative Example 2e | Core material of Comparative Example 1e | Acrylic resin | 5.5 | 1.4 | 91.7 | 6.9(*) | 0.08 | 4.51 | 0.94 | 1.71 |
| Comparative Example 2f | Core material of Comparative Example 1f | Acrylic resin | 5.5 | 1.3 | 93.7 | 5.0(*) | 0.05 | 4.56 | 0.92 | Not measurable |

| | Properties after resin filling | | | | | | | | | |
|---|---|---|---|---|---|---|---|---|---|---|
| | Volume average particle size (μm) | Magnetization ($A \cdot m^2/kg$) | Electric resistance (Ω) | Strength (%) | Initial charge quantity (μC/g) | Saturated charge quantity (μC/g) | Charge quantity after stress (μC/g) | Toner breakage | Toner spent amount (%) | Scattering amount (mg) |
| Example 2a | 36.9 | 58 | $4.5 \times 10^{11}$ | 96.1 | 28.8 | 29.2 | 27.9 | Scarcely observed | 0.3 | 2.1 |
| Example 2b | 35.4 | 60 | $1.8 \times 10^{11}$ | 97.2 | 27.3 | 28.6 | 27.4 | Scarcely observed | 0.4 | 2.4 |
| Example 2c | 35.8 | 62 | $9.9 \times 10^{10}$ | 97.1 | 26.8 | 28.2 | 27.9 | Scarcely observed | 0.7 | 4.5 |
| Example 2d | 38.2 | 63 | $7.8 \times 10^{10}$ | 96.8 | 26.1 | 27.2 | 27.1 | Scarcely observed | 1.5 | 8.1 |
| Example 2e | 39.1 | 59 | $3.7 \times 10^{11}$ | 98.1 | 24.2 | 25.3 | 23.1 | Scarcely observed | 1.8 | 7.3 |
| Comparative Example 2a | 57.4 | 58 | $6.7 \times 10^{11}$ | 93.2 | 14.3 | 10.9 | 5.8 | Very much | 7.2 | 33 |
| Comparative Example 2b | Not measurable | 56 | Not measurable | Not measurable | Poor mixing generated | Poor mixing generated | Poor mixing generated | Poor mixing generated | Poor mixing generated | 156 |

TABLE 2-continued

| | | | | | | | | | | |
|---|---|---|---|---|---|---|---|---|---|---|
| Comparative Example 2c | 22.3 | 44 | $1.2 \times 10^{14}$ | 57.8 | 16.7 | 31.9 | 2.1 | Scarcely observed | 8.9 | 96 |
| Comparative Example 2d | 30.9 | 94 | $2.6 \times 10^{4}$ | 65.7 | 12.7 | 8.4 | 3.5 | Very much | 7.5 | 219 |
| Comparative Example 2e | 36.8 | 29 | $3.3 \times 10^{13}$ | 82.9 | 6.9 | 18.2 | 5.5 | Much | 6.4 | 48 |
| Comparative Example 2f | 23.1 | 55 | $7.9 \times 10^{12}$ | 85.1 | Poor mixing generated | Poor mixing generated | Poor mixing generated | Poor mixing generated | Poor mixing generated | 137 |

(*)excluding free resin

As clarified from the results shown in Table 1 and Table 2, the resin-filled type carriers using the ferrite core materials shown in Examples 1a to 1c have high strengths in spite of low specific gravities, high initial charge quantities, small differences between the initial charge quantities and saturated charge quantities, and are excellent in charging speeds. Further, they have no toner breakage after stress and little toner spent, and exhibit little changes in the charge quantities as compared with the initial ones. Additionally, the resins are uniformly and suitably filled; little aggregation at resin filling is observed; and the scattering amounts are very small.

The carrier obtained in Comparative Example 2a has a high true density as compared with the carriers obtained in Examples 2a to 2e, and has aggregation generated at resin filling as evidenced from the volume average particle sizes. Further, much toner breakage by agitation of 36 hours is observed, and the toner spent is simultaneously large. Hence, a large difference between the initial charge quantity and saturated charge quantity, and the charge quantity after stress is generated, thereby not providing a stable property. Further, a sufficiently light weight cannot be achieved, and the scattering amount has a bad result due to aggregated particles generated at resin filling.

The carrier obtained in Comparative Example 2b has a low continuous void degree of the core material, the core material not fully filled with the formulated resin, and much free resin generated. Aggregation between particles is intense. Consequently, the cross-section, true density, volume average particle size, etc. of the carrier could not be measured. Even properties including charge quantity could not be measured because of the poor mixing by the influence of the free resin at mixing and agitating with the toner. The large scattering amount is considered to result from the free resin which cannot be held on the magnet roll.

The magnetic powder-dispersed carrier of Comparative Example 2c has a low strength, a low fluidity, also a large difference between the initial charge quantity and the saturated charge quantity, and a very slow charging speed. Although the toner breakage after agitation of 36 hours is not observed, much toner spent is observed, and the charge quantity after stress is very low and unstable, influenced by the carrier breakage as well. Since particles of fine powder containing magnetic powder generated by the carrier breakage has a low magnetization, they cannot be held on the magnet roll, and the scattering amount exhibits a bad result.

Carriers obtained in Comparative Example 2d and Comparative Example 2e uses ferrite core materials whose BET areas are relatively large, but do not have a sufficient resin-retentive capability because of low void fractions and low continuous void degree. Consequently, the resin is not filled, and much free resin is observed. The particle aggregation is also intense, and the poor initial charge is generated. Although the measured true density is lower than that of the core material, it actually results from the free resin as described above, and the carrier itself is not made to be of light weight, so much toner breakage by the agitation of 36 hours is observed, and much toner spent is simultaneously observed. From this, a large difference between the initial charge quantity and saturated charge quantity, and the charge quantities after stress is generated, thereby not providing a stable property. That its sufficiently light weight is not achieved, that much free resin is generated, and further that aggregated particles are generated at resin filling cause a bad result of the scattering amount.

A carrier obtained in Comparative Example 2f uses a ferrite core material having a relatively large BET area, but does not have a sufficient resin-retentive capability because of a low void degree and a low continuous void fraction. Since a hard magnetic ferrite core material having a high residual magnetization is used, the fluidity is poor, and the fluidity and the apparent density cannot be measured. Magnetic aggregation is generated due to a high residual magnetization, resulting in a poor fluidity, then causing poor mixing in mixing with the toner, whereby the evaluation of charging characteristics cannot be conducted. Further, as described above, since the resin is not fully retained, and much free resin is present, the scattering amount exhibits a bad result.

EXAMPLE 3

Example 3a

On the surface of the resin-filled type carrier obtained in Example 2c, the same silicone resin as the filled resin of 2 wt. % with respect to the carrier weight was coated using a fluidized bed coating machine. Now, a conductive carbon as a conductive agent of 2 wt. % with respect to the coating resin solid content was added in the coating resin. The resin-filled type carrier is, after coated, heated at 220° C. for 2 hours to obtain a resin-filled type carrier whose surface is coated with the resin.

Comparative Example 3a

On the surface of the carrier obtained in Comparative Example 2a, the same acrylic resin as that used in Comparative Example 2a of 2 wt. % with respect to the carrier weight was coated using a fluidized bed coating machine. The resin-filled type carrier is, after coated, heated at 160° C. for 2 hours to obtain a resin-coated type carrier whose surface is coated with the resin.

The charge properties, toner breakage state and toner spent of the resin-coated type carrier thus obtained were measured as by the methods as described before. The results are shown in Table 3.

TABLE 3

| | Carrier before coatng | Coating resin | Coating amount (%) | Properties after resin coating: Coating layer thickness | Initial charge quantity (μC/g) | Saturated charge quantity (μC/g) | Charge after stress (μC/g) | Toner breakage | Toner spent amount (%) |
|---|---|---|---|---|---|---|---|---|---|
| Example 3a | Example 2c | Silicone resin | 2 | about 1.2 μm | 30.2 | 30.8 | 30.1 | Scarcely observed | 0.1 |
| Comparative Example 3b | Comparative Example 2a | Acrylic resin | 2 | about 1.2 μm | 16.8 | 11.9 | 4.1 | Very much | 11.2 |

As clarified from the results of Table 3, the carrier obtained in Example 3a has a high charging speed, a stable charge quantity after stress, and little toner breakage and toner spent, exhibiting remarkably excellent characteristics. By contrast, the carrier obtained in Comparative Example 3b does not present evidence of the improvement in bad characteristics before coating, conversely leading to an inferior result to before coating in point of toner spent.

The resin-filled type carrier relevant to the present invention, because a resin is filled, has a low true density, achieves an elongated life, and excels in fluidity, and by selection of the filling resin, can easily control charge quantity and the like. Additionally, it has a high strength as compared with magnetic powder-dispersed carriers, and no cracking, deformation and melting by heat and impact.

Accordingly, the electrophotographic developer using the above resin-filled type carrier secures sufficiently an image density, has no carrier adhesion over a long period, and can maintain high-quality images, and is therefore extensively applicable to fields of full-color machines requiring especially high-quality images and high-speed machines requiring reliability and durability of image sustainability.

What is claimed is:

1. A ferrite core material for a resin-filled type carrier, wherein the ferrite core material has a void fraction of 10 to 60%, a continuous void degree of 1.8 to 4.0, the ferrite core material is a Mn—Mg—Sr ferrite, and wherein a ratio of a true density, after resin filling, to a true density of the core material (true density after resin filling/true density of a core material) is 0.50 to 0.90.

2. The ferrite core material for a resin-filled type carrier according to claim 1, wherein the true density thereof is 3.0 to 5.5 g/cm$^3$.

3. The ferrite core material for a resin-filled type carrier according to claim 1, wherein the apparent density thereof is 0.7 to 2.5 g/cm$^3$.

4. The ferrite core material for a resin-filled type carrier according to claim 1, wherein the average particle size thereof is 15 to 80 μm.

5. The ferrite core material for a resin-filled type carrier according to claim 1, wherein the resistance thereof is $10^2$ to $10^{12}\Omega$.

6. The ferrite core material for a resin-filled type carrier according to claim 1, wherein the residual magnetization thereof is 15 emu/g (A·m$^2$/kg) or less.

7. The ferrite core material for a resin-filled type carrier according to claim 1, wherein the sintered primary particle size thereof is 0.2 to 10 μm.

8. The ferrite core material for a resin-filled type carrier according to claim 1, wherein the ratio of the volume average particle size thereof to the sintered primary particle size thereof (volume average particle size/sintered primary particle size) is 5 to 200.

9. A resin-filled type carrier obtained by filling a carrier core material according to claim 1 with the resin.

10. The resin-filled type carrier according to claim 9, wherein the resin filling amount thereof is 6 to 30 wt. %.

11. The resin-filled type carrier according to claim 9, wherein the void fraction thereof is 1 to 50%.

12. The resin-filled type carrier according to claim 9, wherein the ratio of the resin-filled area rate thereof to the core material area rate thereof (resin-filled area rate/core material area rate) is 0.20 to 0.80.

13. The resin-filled type carrier according to claim 9, wherein the true density thereof after resin filling is 2.50 to 4.50 g/cm$^3$.

14. The resin-filled type carrier according to claim 9, wherein the average particle size thereof is 15 to 80 μm.

15. The resin-filled type carrier according to claim 9, wherein the magnetization thereof is 20 to 90 emu/g (A·m$^2$/kg).

16. The resin-filled type carrier according to claim 9, wherein the electric resistance is $10^5$ to $10^{15}\Omega$.

17. The resin-filled type carrier according to claim 9, wherein the resin-filled type carrier is coated with a resin.

18. The resin-filled type carrier according to claim 17, wherein the surface coating thickness thereof is 0.01 to 7 μm.

19. An electrophotographic developer comprising a resin-filled type carrier according to claim 9 and a toner.

20. The electrophotographic developer according to claim 19, wherein the ratio of the true density of the toner to the true density of the resin-filled type carrier (a true density of the toner/a true density of the carrier) is 1/5 to 1/2.

21. The resin-filled type carrier according to claim 9, wherein the resin is a silicon resin.

22. The ferrite core material for a resin-filled type carrier according to claim 1, wherein said material has sufficient voids continuing from the surface to result in a resin filling amount of 8 to 25 wt. %.

23. A resin-filled type carrier, comprising a ferrite core material and having:

a void fraction of 10 to 60%;

a continuous void degree of 1.8 to 4.0; and a Mn—Mg—Sr ferrite; and at least one of:

an apparent density thereof is 0.7 to 2.5 g/cm$^3$; and an average particle size of 15 to 80 μm, wherein a ratio of a true density, after resin filling, to a true density of the core material (true density after resin filling/true density of a core material) is 0.50 to 0.90.

24. A resin-filled type carrier comprising a ferrite core material comprising a Mn—Mg—Sr ferrite and having:

a void fraction of 10 to 60%;

a continuous void degree of 1.8 to 4.0;

an apparent density thereof is 0.7 to 2.5 g/cm$^3$; and an average particle size of 15 to 80 μm, wherein the ferrite core material is usable with the resin-filled type carrier of an electrophotographic developer, wherein a ratio of a true density, after resin filling, to a true density of the core material (true density after resin filling/true density of a core material) is 0.50 to 0.90.

* * * * *